US006313726B1

(12) United States Patent
Golovatai-Schmidt et al.

(10) Patent No.: US 6,313,726 B1
(45) Date of Patent: Nov. 6, 2001

(54) ELECTROMAGNET, PARTICULARLY A PROPORTIONAL MAGNET FOR OPERATING A HYDRAULIC VALVE

(75) Inventors: Eduard Golovatai-Schmidt, Röttenbach; Martin Steigerwald; Jens Schäfer, both of Herzogenaurach, all of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/388,348

(22) Filed: Sep. 1, 1999

(30) Foreign Application Priority Data

Sep. 2, 1998 (DE) ..... 198 39 884

(51) Int. Cl.[7] ..... H01F 7/08
(52) U.S. Cl. ..... 335/220; 251/129.15; 251/129.09
(58) Field of Search ..... 335/220, 222, 335/228, 261–3, 270, 273–80, 281; 251/129.01–129.15

(56) References Cited

U.S. PATENT DOCUMENTS

| | | | | |
|---|---|---|---|---|
| 4,836,248 | * | 6/1989 | Stegmaier | 137/625 |
| 5,114,116 | * | 5/1992 | Muller et al. | 251/129.15 |
| 5,252,939 | | 10/1993 | Reifler et al. . | |

FOREIGN PATENT DOCUMENTS

| | | |
|---|---|---|
| 18568 | 4/1960 | (DE) . |
| 2255272 | 4/1979 | (DE) . |
| 3147062 | 6/1983 | (DE) . |
| 3419105 | 11/1985 | (DE) . |
| 2823257 | 6/1987 | (DE) . |
| 4410157 | 9/1995 | (DE) . |
| 1355032 | 5/1974 | (GB) . |

* cited by examiner

*Primary Examiner*—Lincoln Donovan
(74) *Attorney, Agent, or Firm*—Bierman, Muserlian and Lucas

(57) ABSTRACT

An electromagnet (1), particularly a proportional magnet for operating a hydraulic valve, said electromagnet (1) comprising at least one coil winding (3) carried by a hollow cylindrical coil spool (2) which is circumferentially surrounded by a hollow cylindrical magnet housing (4) and limited at each end by a pole shoe (5, 6), said electromagnet (1) further comprising an axially moveable cylindrical armature (8) which is arranged in a hollow cylinder of the coil spool (2) that is configured as an armature space (7), the armature (8) being mounted for low friction in rotary, longitudinally moveable axial guides, and electromagnetically produced axial movements of the armature (8) can be transmitted to a hydraulic valve piston via a push rod (10) which is connected to the armature (8) to form an axial extension thereof. According to the invention, the rotary, longitudinally moveable axial guides of the armature (8) comprise at least one bushing-less linear ball bearing having a number of circumferentially spaced balls while being configured at the same time as an anti-stick means of the armature. The outer peripheral surface (9) of the armature (8) and/or the outer peripheral surface (11) of the push rod (10) is configured as an inner running track for the balls, and the inner peripheral surface of one or more components which limit the armature space (7) of the coil spool (2) forms an outer running track for the balls.

15 Claims, 4 Drawing Sheets

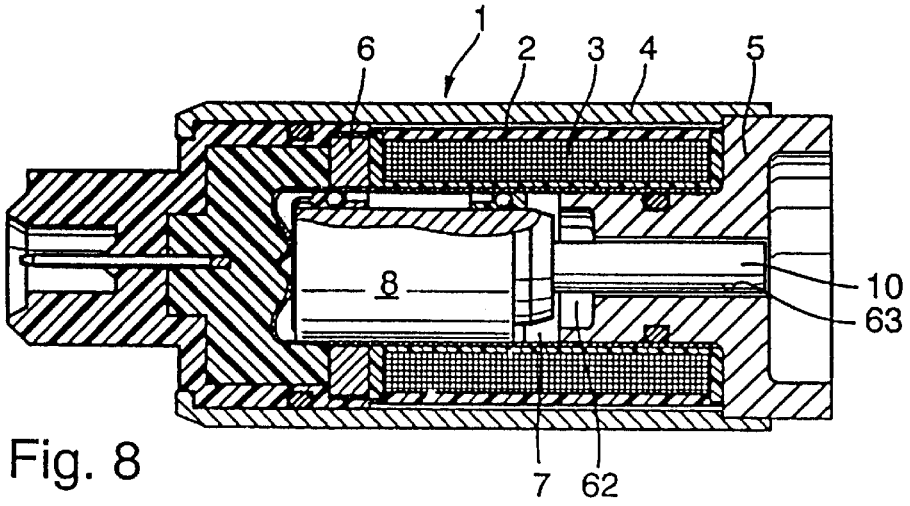
Fig. 8
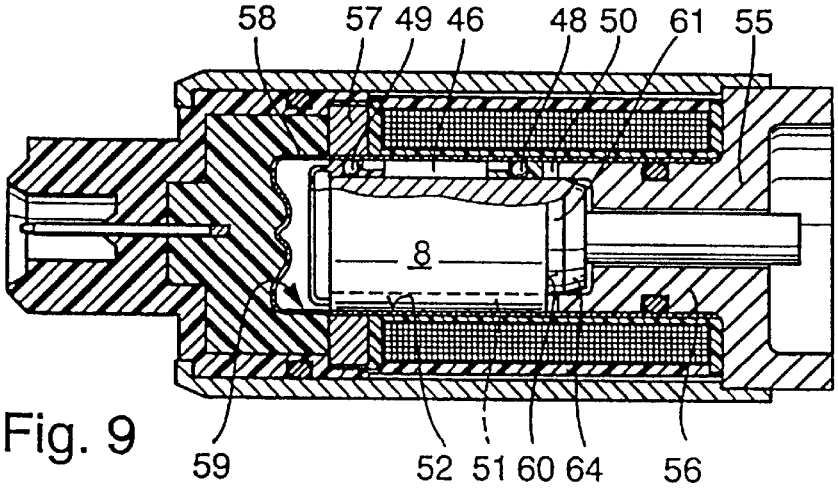
Fig. 9
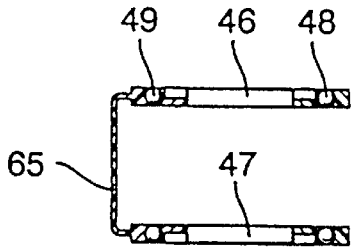
Fig. 10a
Fig. 10b
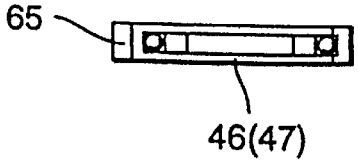
Fig. 10c
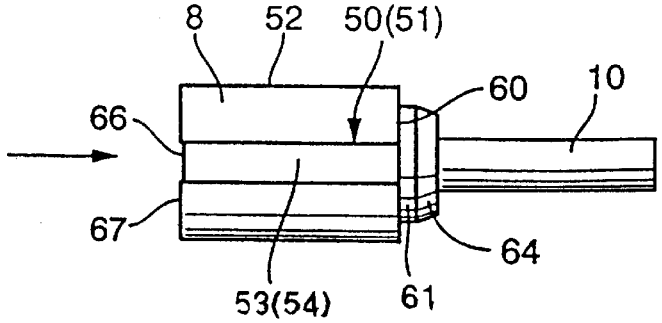

ELECTROMAGNET, PARTICULARLY A PROPORTIONAL MAGNET FOR OPERATING A HYDRAULIC VALVE

FIELD OF THE INVENTION

The invention concerns an electromagnet, particularly a proportional magnet for operating a hydraulic valve which is installed within a hydraulic system of a device for varying valve timing in an internal combustion engine, said electromagnet comprising at least one coil winding carried by a hollow cylindrical coil spool which is circumferentially surrounded by a hollow cylindrical magnet housing and limited at each end by a pole shoe, said electromagnet further comprising an axially moveable cylindrical armature which is arranged in a hollow cylinder of the coil spool that is configured as an armature space, the armature being mounted for low friction in rotary, longitudinally moveable axial guides, and electromagnetically produced axial movements of the armature can transmitted to a hydraulic valve piston against the force of a spring via a push rod which is connected to the armature to form an axial extension thereof.

BACKGROUND OF THE INVENTION

A generic proportional or adjusting magnet of the precited type is known from DE-OS 22 55 272. This adjusting magnet essentially comprises a hollow cylindrical coil spool and a coil winding arranged thereon. The coil spool and the coil winding are collectively enclosed circumferentially by a hollow cylindrical magnet housing. The coil spool is limited at its ends by two axially spaced pole shoes, one of which pole shoes is structurally integral with the magnet housing. The adjusting magnet further comprises an axially moveable cylindrical armature which is arranged in the hollow cylinder of the coil spool that is configured as an armature space. The electromagnetically produced axial movements of the armature are transmitted against the force of a compression spring to a hydraulic valve piston via a push rod connected to the armature. The armature is mounted for low friction in rotary, longitudinally moveable axial guides so that a uniform air gap is formed between the outer peripheral surface of the armature and the coil spool, and the radial forces acting on the armature, which increase considerably with an increasing eccentricity of the armature, are reduced to a minimum. The rotary, longitudinally moveable axial guides are configured as two axial ball bearings which are pressed into the pole shoes of the adjusting magnet. The ends of the push rod, which has an extension on one side and which extends axially through the armature, are mounted in these ball bearings. In the interior of each axial ball bearing, there is arranged an axially moveable ball cage with a number of circumferentially uniformly spaced balls whose inner running track is formed by the outer peripheral surface of the push rod, while the outer running track is formed by the inner peripheral surfaces of the two bearing bushings. The armature is mounted in these axial ball bearings for axial movements between the pole shoes, and, for avoiding a seating of the armature on the pole shoes and the concomitant sudden increase of axial force on the armature, so-called anti-stick discs of a non-ferromagnetic material are arranged on the ends of the armature.

A drawback of this prior art adjusting magnet is that, although the axial ball bearings for the rotary, longitudinal axial guidance of the armature have very good friction properties, their complicated structure consisting of bearing bushing, ball cage and balls is relatively cost-intensive, and their assembly is thus likewise complicated and expensive, so that the total manufacturing costs of an adjusting magnet of this type are unreasonably high. Moreover, the wall thicknesses of the bearing bushings of such axial ball bearings, which are generally made by deep drawing, are inherently non-uniform due to the peculiarities of their shaping process and this results in a non-concentricity of their inner peripheral surfaces so that it is only rarely possible to achieve the desired exact, centered mounting of the armature, and undesired radial forces acting on armature cannot be eliminated.

OBJECTS OF THE INVENTION

It is therefore an object of the invention to provide an electromagnet, particularly a proportional magnet for operating a hydraulic valve whose armature is provided with a low-friction rotary, longitudinally moveable axial guide which has an inexpensive simple configuration and assures, in all cases, an exact, centered mounting of the armature.

This and other objects and advantages will become obvious from the following detailed description.

SUMMARY OF THE INVENTION

The invention achieves the above objects by the fact that the rotary, longitudinally moveable axial guides of the armature comprise at least one bushing-less linear ball cage having a number of circumferentially spaced balls while being configured at the same time as an anti-stick means of the armature, an outer peripheral surface of the armature and/or an outer peripheral surface of the push rod is configured as an inner running track for the balls, and an inner peripheral surface of one or more components limiting the reception of the coil spool forms an outer running track for the balls.

In a first embodiment of the electromagnet of the invention, the rotary, longitudinally moveable guides of the armature are preferably formed by two spaced-apart linear ball cages which are made of a plastic or of a non-ferromagnetic material and comprise at least two circulating rows of balls which are uniformly spaced circumferentially. These linear ball cages are arranged opposite the end faces of the armature directly on the push rod which is preferably elongated and extends axially through the armature so that the outer peripheral surface of the push rod, which may also be made up of two parts, serves as the inner running track for the balls of the linear ball cages. The components limiting the reception of the coil spool and formed with the outer running tracks for the balls of the linear ball cages are constituted in this embodiment by the pole shoes of the proportional magnet. Each of these pole shoes is made up preferably of a pole plate and a hollow cylindrical pole core which extends axially away from the pole plate into the reception of the coil spool. Each pole core comprises a larger hollow cylinder and a smaller hollow cylinder, and the inner peripheral surfaces of the smaller hollow cylinders of the pole cores form outer running tracks for the linear ball cages. It has proved to be particularly advantageous to configure the larger hollow cylinders of the pole cores of both pole shoes, which receive at least the end regions of the armature, with a stepped transition to the smaller hollow cylinders of the pole cores of the pole shoes and use the transitions as axial stroke limiters for the armature.

In a further advantageous modification of this first embodiment of the electromagnet of the invention, an annular collar integrally formed on the armature-proximate end of each linear ball cage is arranged in the respective stroke end position of the armature between the end face of the armature and the transition to the smaller hollow cylinder of each pole core. These annular collars are made of the same material as the linear ball cages and are configured as an anti-stick means of the armature. The function of preventing a direct seating of the armature on the transitions of the pole shoes, which is otherwise performed by a separately arranged anti-stick disc, is thus integrated by the annular collars in an economic manner into the two linear ball cages themselves.

As far as materials are concerned, it has been determined that a push rod made preferably of a non-ferromagnetic material has an adequate strength for resisting without deformation, the ball contact pressure of the linear ball cages produced during operation on its outer peripheral surface which is configured as the inner running track for the balls. Due to better osculation conditions, the ball contact pressure on the inner peripheral surface of the smaller hollow cylinders serving as the outer running track for the balls is smaller than in the case of the push rod, so that even the hardness of pole shoes made of a soft iron or of a low alloy steel is sufficient for absorbing the occurring axial forces. However, to minimize the cost of production of the pole shoes of the electromagnet of the invention, it is further proposed to make the pole shoes preferably as soft iron extrusion molded parts whose ferromagnetic properties which deteriorate during the forming process can be re-established by recrystallization annealing. In addition to this, it is also possible to compensate for a possible reduction of material strength at least on the inner peripheral surfaces of the smaller hollow cylinders of the pole shoes by an additional surface treatment, for example nitriding, to increase the strength of these inner peripheral surfaces to a level adequate for ball running tracks. As has been determined, the deterioration of the magnetic field caused by such a coating is negligible.

In a second embodiment of the electromagnet of the invention, in contrast, the rotary, longitudinally moveable axial guides of the armature are configured preferably as a single linear ball cage made of a plastic or a non-ferromagnetic material which comprises at least two axially spaced-apart rows of balls, said linear ball cage being arranged on the outer peripheral surface of a reduced-diameter portion of the armature which is configured as the inner running track of the balls of the linear ball cage. The spacing between the ball rows is preferably chosen so as to assure an optimal support both during axial displacement and tilting of the armature. In a minimum-cost version, the linear ball cage which is similarly arranged, has only one row of balls and, axially spaced therefrom, a sliding bearing portion, so that the reduced-diameter portion of the armature is configured not only as the inner running track of the balls but also as the inner sliding surface of the sliding bearing portion of the linear ball cage.

According to a further advantageous feature of the second embodiment of the electromagnet of the invention, the structure of the first embodiment is slightly modified in that one pole shoe of the proportional magnet again preferably comprises a pole plate and a hollow cylindrical pole core extending away therefrom into the reception of the coil spool, while the other pole shoe consists only of an annular pole plate. A pressure pipe which lines the entire reception extends through this annular pole plate and constitutes, in this case, the component limiting the reception of the coil spool, the inner peripheral surface of the pressure pipe forming the outer running track for the balls of the linear ball cage, and where applicable, the outer sliding surface of the sliding bearing portion. To avoid magnetic short circuits, the pressure pipe is made of a non-ferromagnetic material and, similar to the reduced-diameter portion of the peripheral surface of the armature also has an increased strength or a strength suitable for ball running surfaces which is obtained by an additional surface treatment such as nitriding so that the fatigue strength required for resisting the surface pressure exerted by the balls on the inner and the outer running tracks is guaranteed.

In the second embodiment of the electromagnet of the invention, the simultaneous function of the linear ball cage as an anti-stick means of the armature is obtained in that the reduced-diameter portion of the peripheral surface of the armature, which preferably forms a step-like shoulder with respect to the rest of the peripheral surface of the armature, has a larger axial dimension than the linear ball cage and, in one of the end positions of the armature, sinks with its end connected to the push rod into a counterbore which is arranged at the armature-proximate end of a through-bore provided for inserting the push rod through one of the pole shoes of the electromagnet. The linear ball cage arranged on the armature is supported, preferably in the live-state end position of the armature, on one side on the step-shaped shoulder of the armature and on the other side, on the armature-proximate end face of the pole core of the one pole shoe so that the cage acts as an anti-stick spacer which prevents a seating of the armature in the counterbore of the through-bore for the push rod in the one pole shoe. In the other end position, preferably the dead-state end position of the armature, into which the armature is displaced by the auxiliary energy of a compression or tension spring, the armature bears against the inner end face of the non-ferromagnetic pressure pipe which lines the reception.

Finally, the invention can achieve its objects alternatively in that the rotary, longitudinally moveable guides of the armature comprise at least two bushing-less ball cage strips which are made of a plastic or a non-ferromagnetic material with at least two axially spaced-apart balls, which strips are arranged within radially opposite axial grooves provided in the outer peripheral surface of the armature, the bottom surface of each axial groove forming the inner running track for the balls and the inner peripheral surface of a component limiting the reception of the coil spool forming the outer running track for the balls of the ball cage strips.

Just as in the preceding embodiment, in this embodiment, too, one pole shoe of the electromagnet preferably comprises a pole plate and a hollow cylindrical pole core which extends axially away therefrom into the reception of the coil spool, while the other pole shoe is formed by an annular pole plate through which is again inserted a pressure pipe which lines the entire reception and whose inner peripheral surface forms the outer running track for the balls of the ball cage strips. To avoid a magnetic short circuit, this pressure pipe is likewise made of a non-ferromagnetic material and, like the axial grooves in the outer peripheral surface of the armature, has an increased strength or a strength suitable for ball tracks which is obtained by an additional surface treatment with a view to guaranteeing a fatigue strength capable of resisting the surface pressure exerted by the balls.

According to a further feature of this embodiment of the electromagnet of the invention, the armature additionally comprises at its end connected to the push rod, a reduced-diameter portion with which, similar to the preceding embodiment, it sinks in the one, preferably the live-state end position of the armature, into a counterbore which is arranged at the armature-proximate end of a through-bore of the one pole shoe of the electromagnet through which the push rod is inserted. An anti-stick disc applied to the reduced-diameter portion of the armature prevents, in a manner known, per se, a direct seating of the armature in the counterbore of the through-bore through which the push rod is inserted, and thus also, the sudden increase of the axial force of the armature that would result therefrom.

According to a further advantageous feature of the invention, finally, the individual ball cage strips are preferably configured as a strip assembly by connecting them to each other by a retaining clip. In the other, preferably the dead-state end position of the armature, this retaining clip sinks into a cross groove on the other end face of the armature so that the stroke length of the armature is not disadvantageously shortened.

Thus, all the described embodiments of the electromagnet of the invention, particularly a proportional magnet, have the advantage over prior art electromagnets having rotary, longitudinally moveable guides that the rotary, longitudinally moveable guides of the invention have a very simple structure obtained by the use of naked linear ball cages or ball cage strips without bushings and therefore, and also because they can be made of a plastic, the manufacturing of these linear ball cages and ball cage strips is extremely economical. For this reason and also due to the possibility of very simple assembly of these linear ball cages and ball cage strips, the increase of the total manufacturing costs of an electromagnet of the invention as compared to those having armatures without rotary longitudinally moveable guides is only insignificant. At the same time, the "omission" of bushings of the linear ball cages and ball cage strips has the positive technical effect that, as already described in the introductory part of this description, the radial forces on the armature resulting from the non-concentricity of the inner peripheral surfaces of the bearing bushings can no longer occur and therefore an exact, centered mounting of the armature is guaranteed in every case.

The invention will now be described more closely with reference to the attached drawings.

BRIEF DESCRIPTION OF THE DRAWINGS

FIG. 8 is a cross-section through a third embodiment of an electromagnet of the invention in a dead-state position of the armature;

FIG. 9 is a cross-section through the third embodiment of the electromagnet of the invention in a live-state position of the armature;

FIG. 10*a* is a detail showing a top view of the rotary longitudinally moveable axial guide of the third embodiment of the electromagnet of the invention;

FIG. 10*b* is a detail showing a side view of the rotary longitudinally moveable axial guide of the third embodiment of the electromagnet of the invention;

FIG. 10*c* is a detail showing a side view of the armature of the third embodiment of the electromagnet of the invention.

DETAILED DESCRIPTION OF THE DRAWINGS

Figure 1:
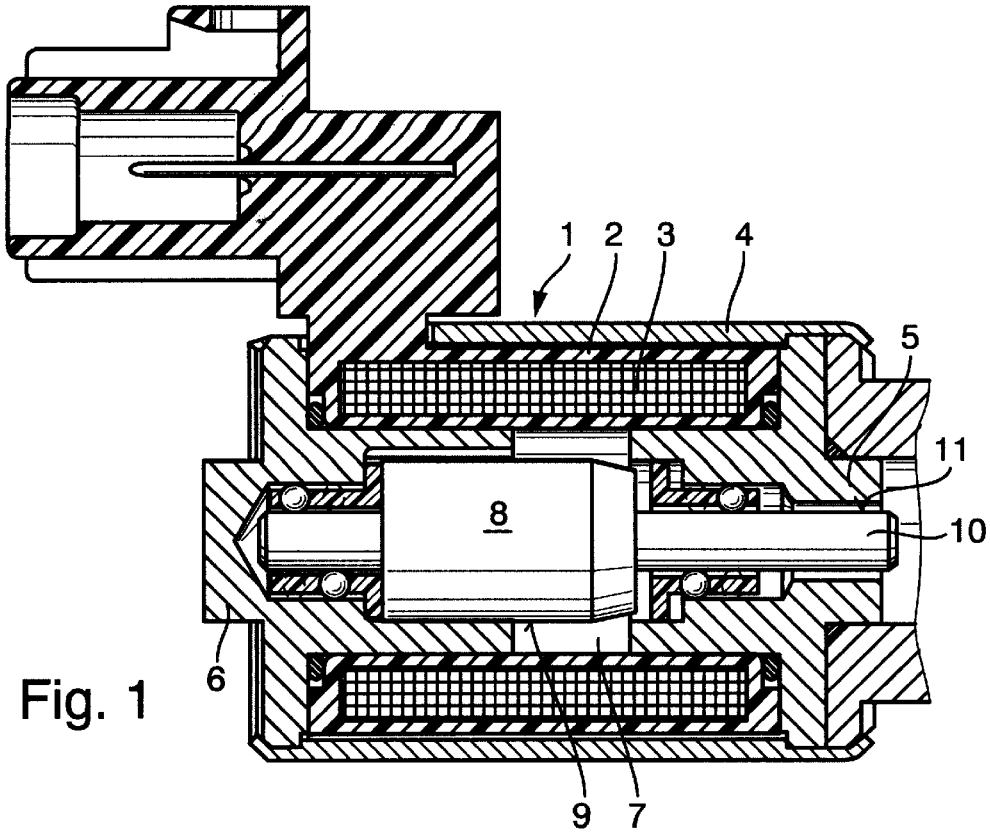
FIG. 1 is a cross-section through a first embodiment of an electromagnet of the invention in a dead-state position of the armature.
Figure 5:
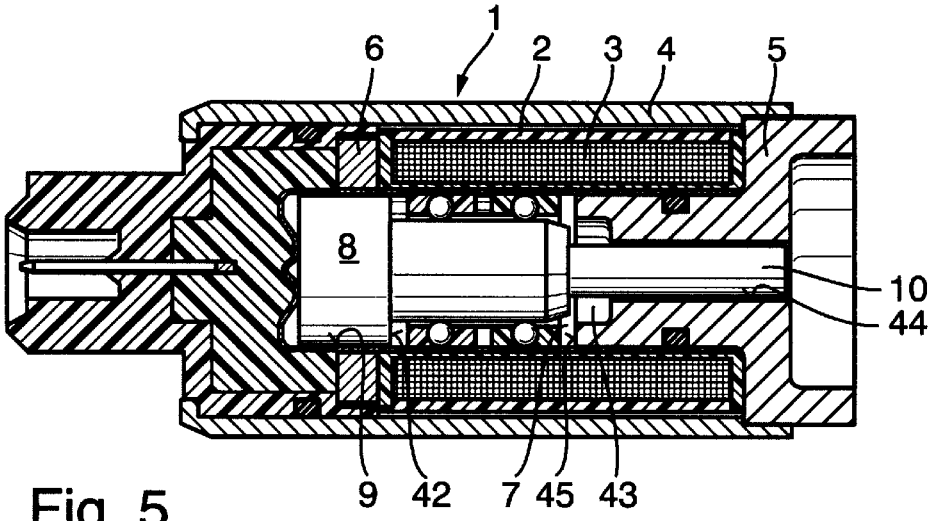
FIG. 5 is a cross-section through a second embodiment of an electromagnet of the invention in a dead-state position of the armature.

FIGS. 1, 5 and 8 clearly show an electromagnet 1 with which a hydraulic valve, not shown, arranged within a hydraulic system of a device for varying the valve timing of an internal combustion engine can be operated. This electromagnet 1 comprises, in a known manner, a hollow cylindrical coil spool 2 and a coil winding 3 carried by the coil spool 2, said coil spool and coil winding being collectively surrounded circumferentially by a hollow cylindrical magnet housing 4. The coil spool is limited at its ends by two axially spaced apart pole shoes 5, 6 through which the magnetic field produced by feeding electric current to the coil winding 3 is conducted into the hollow cylinder of the coil spool 2 forming the reception 7. An axially moveable cylindrical armature 8 is arranged for low friction in rotary, longitudinally moveable axial guides in this reception 7, and the electromagnetically produced axial movements of the reception are transmitted to a hydraulic valve piston against the force of a compression spring, also not shown, via a non-ferromagnetic push rod 10 which is connected to the armature 8 to form an axial extension thereof.

Figure 2:
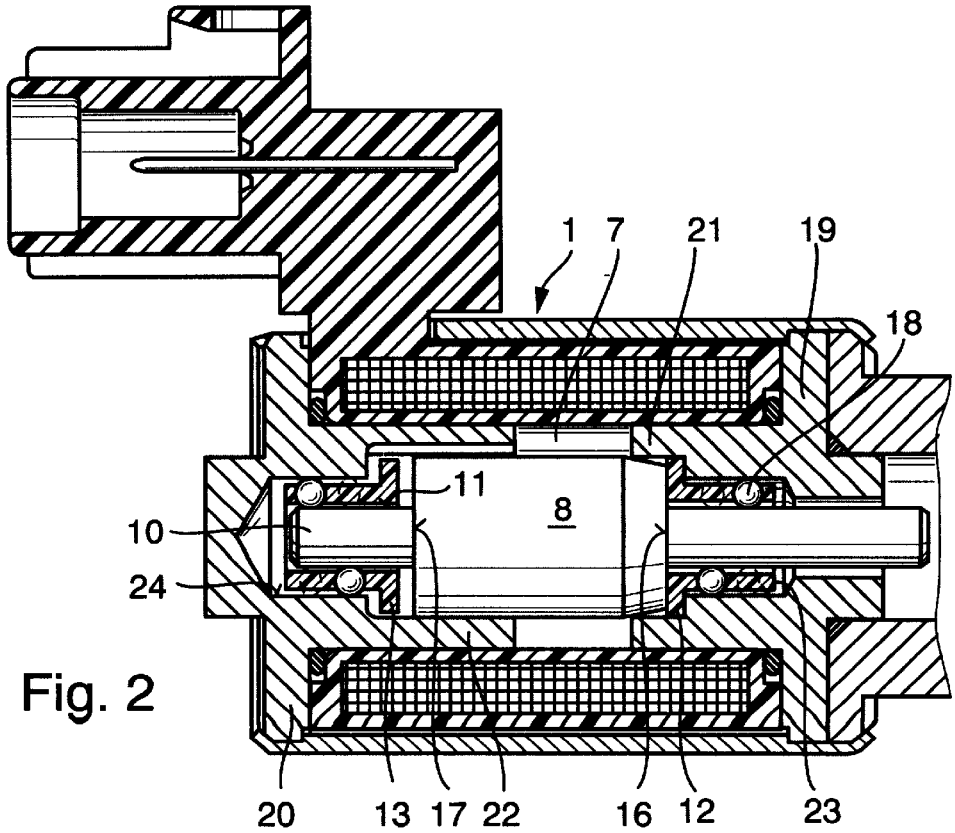
FIG. 2 is a cross-section through the first embodiment of the electromagnet of the invention in a live-state position of the armature.
Figure 3B:
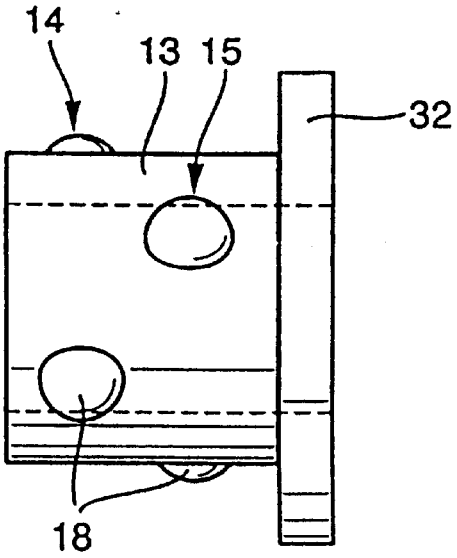
FIG. 3*b* is an enlarged representation of the second rotary axial guide of the first embodiment of the electromagnet of the invention.
Figure 3A:
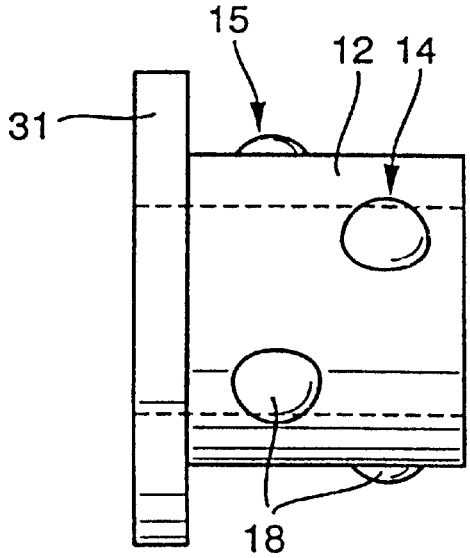
FIG. 3*a* is an enlarged representation of the first rotary longitudinally moveable axial guide of the first embodiment of the electromagnet of the invention.
Figure 6:
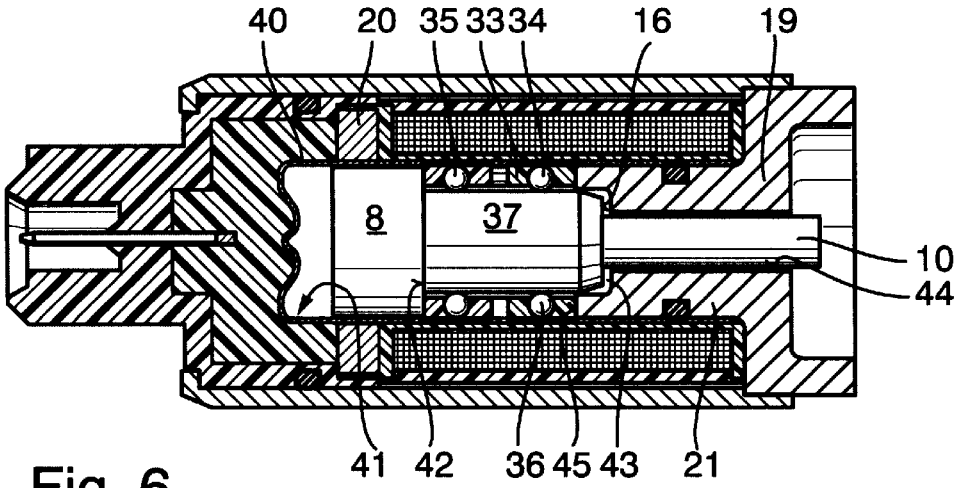
FIG. 6 is a cross-section through the second embodiment of the electromagnet of the invention in a live-state position of the armature.
Figure 7:
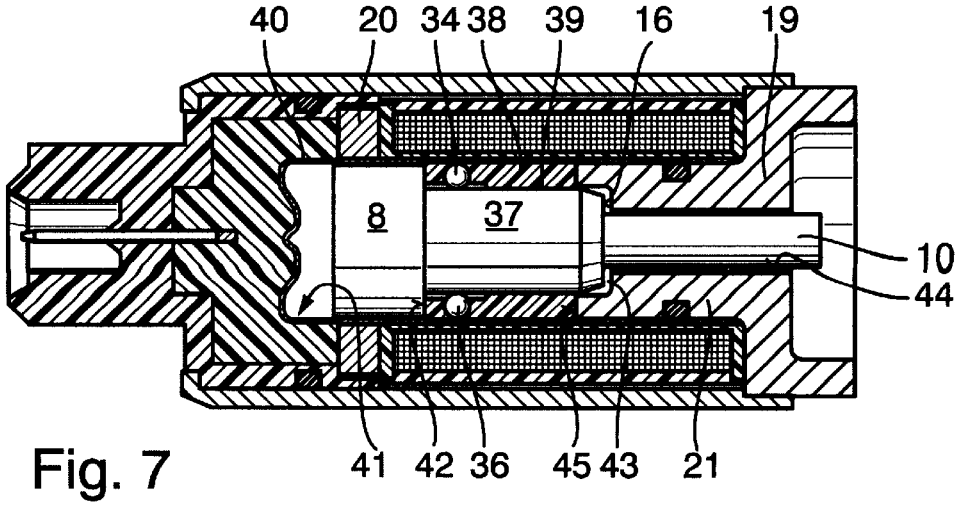
FIG. 7 is a cross-section through a modification of the second embodiment of the electromagnet of the invention in a live-state position of the armature.

In the case of the electromagnet 1 shown in FIGS. 1 and 2, as also in FIGS. 5 to 7, it can be seen further that the rotary, longitudinally moveable axial guides of the armature 8 are formed according to the invention by at least one bushing-less linear ball cage having a number of circumferentially uniformly spaced balls, the cage being configured at the same time as an anti-stick means of the armature 8 for preventing a direct contact of the armature 8 with the pole shoes 5, 6. In the first embodiment of the invention shown in FIGS. 1 and 2, it can be seen that the rotary, longitudinally moveable guides of the armature 8 are formed, in the concrete, by two spaced-apart linear ball cages 12, 13 which are made of a plastic and, as indicated in FIG. 3, each of these cages comprises two circulating rows 14, 15 of balls. These linear ball cages 12, 13 are arranged opposite the end faces 16, 17 of the armature 8 directly on the elongated push rod 10 which is inserted axially through the armature 8 so that the outer peripheral surface 11 of the push rod 10 forms the inner running track for the balls of both the linear ball cages 12, 13.

FIRST EMBODIMENT

Figure 4B:
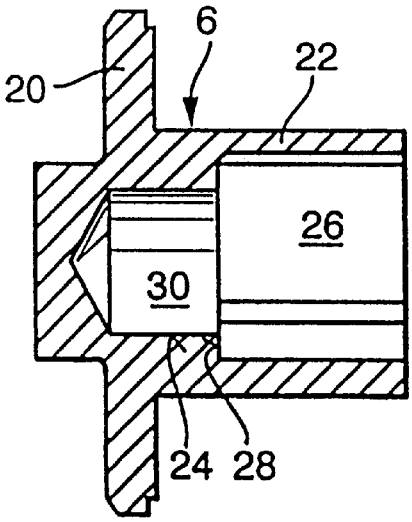
FIG. 4*b* is an enlarged cross-sectional representation of the other pole shoe of the first embodiment of the electromagnet of the invention.
Figure 4A:
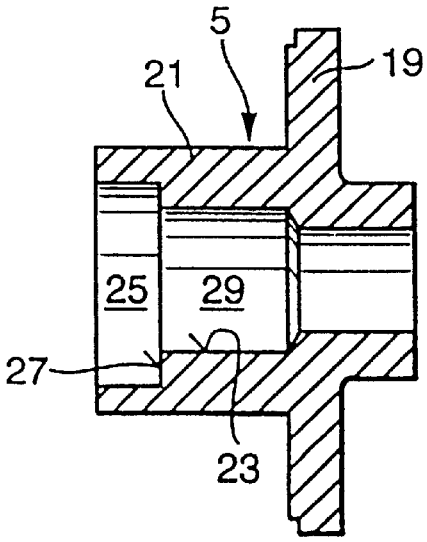
FIG. 4*a* is an enlarged cross-sectional representation of the other pole shoes of the first embodiment of the electromagnet of the invention.

It can be seen from FIG. 4 that each pole shoe 5, 6 of the first embodiment of the electromagnet 1 is made up of a pole plate 19, 20 and a hollow cylindrical pole core 21, 22, and that the pole cores 21, 22 extend away from the respective pole plate 19, 20 into the reception 7 of the coil spool 2. The pole cores 21, 22 comprise larger hollow cylinders 25, 26 which receive the end portions of the armature 8, and smaller hollow cylinders 29, 30 whose inner peripheral surfaces 23, 24 form the outer running tracks for the balls 18 of the linear ball cages 12, 13. Besides this, the larger hollow cylinders 25, 26 of the pole cores 21, 22 comprise stepped transitions 27, 28 to the smaller hollow cylinders 29, 30 of the pole cores 21, 22, which transitions are configured as axial stroke limiters of the armature 8. As shown in FIG. 3, an annular collar 31, 32 configured as an anti-stick means of the armature 8 is formed on the armature-proximate end face of each linear ball cage 12, 13 between the end faces 16, 17 of the armature 8 and the transitions 27, 28 to the smaller hollow cylinders 29, 30 of the pole cores 21, 22. In the stroke end positions of the armature 8, these annular collars 31, 32 prevent a seating of the armature 8 on the transitions 27, 28 in the pole shoes 5, 6. Advantageously, these pole shoes 5, 6 are made as inexpensive soft iron extrusion molded parts, the strength of the inner peripheral surfaces 23, 24 of the smaller hollow cylinders 29, 30 of their pole cores 21, 22 which form running tracks for the balls being additionally increased by nitriding.

FIGS. 5 and 6 show a second embodiment of the electromagnet 1 having generally the same basic structure as the first embodiment with the difference that the rotary, longitudinally moveable guides of the armature 8 are formed by only one linear ball cage 33 which is likewise made of a plastic and comprises two axially spaced-apart ball rows 34, 35, the cage 33 being arranged on a reduced-diameter portion 37 of the outer peripheral surface 9 of the armature 8 which forms the inner running track for the balls 36 of the cage 33. A minimum-cost version of this embodiment is shown in FIG. 7 in which the rotary, longitudinally moveable axial guides of the armature 8 are formed by a plastic linear ball cage 38 having only one ball row 34 and, axially spaced therefrom, a sliding bearing portion 39. The cage 38 is arranged, similar to the previous embodiment, on a reduced-diameter portion 37 of the armature 8 which, in this case, forms both the inner running track for the balls 36 and the inner sliding surface for the sliding bearing portion 39 of the linear ball cage 38.

SECOND EMBODIMENT

As a further difference of the second embodiment from the first, it can be seen in FIGS. 5 to 7 that the one pole shoe 5 of the electromagnet 1 comprises a pole plate 19 and a hollow cylindrical pole core 21 which extends axially away therefrom into the reception 7 of the coil spool 2, while the other pole shoe 6 is formed only by an annular pole plate 20. A non-ferromagnetic pressure pipe 40 lining the entire reception 7 of the coil spool 2 is inserted through this pole plate 20. The inner peripheral surface 41 of this pressure pipe 40 whose strength is increased by additional surface nitriding serves as the outer running track of the balls 36 of the linear ball cage 33 and, where applicable, as the outer sliding surface for the sliding bearing portion 39 of the linear ball cage 38.

It can be seen further in FIGS. 5 to 7 that the reduced-diameter portion 37 of the armature 8 which forms a circumferential shoulder 42 has a larger axial dimension than the linear ball cage 33 or 38, and, in the live-state end position of the armature 8 shown in FIGS. 6 and 7, sinks with its end 16, which is connected to the push rod 10, into a counterbore 43 that is arranged on the armature-proximate end of a through-bore 44 provided in the one pole shoe 5 of the electromagnet 1 for the insertion of the push rod 10. In this live-state end position of the armature 8, the linear ball cage 33 or 38 is supported on one side on the shoulder 42 of the armature 8 and on the other side, on the armature-proximate end face 45 of the pole core 21 of the one pole shoe 5 so that the linear ball cage acts as a spacer with the function of an anti-stick means of the armature 8 to prevent a seating of the armature 8 in the counterbore 43 of the through-bore 44 of the one pole shoe 5 for the push rod 10.

THIRD EMBODIMENT

The third embodiment of the electromagnet 1 of the invention shown in FIGS. 8 to 10 has generally the same basic structure as the second embodiment but differs therefrom in that the rotary, longitudinally moveable axial guides of the armature 8 are two plastic bushing-less ball cage strips 46, 47 each of which comprises two spaced apart balls 48, 49 and does not fulfil the simultaneous function of an anti-stick means of the armature 8. As can be seen clearly in FIG. 10, these ball cage strips 46, 47 are arranged within radially opposite axial grooves 50, 51 in the outer peripheral surface 52 of the armature 8, and the bottom surface 53, 54 of each axial groove 50, 51 serves as an inner running track of the balls 48, 49. The outer running track of the balls 48, 49 of the ball cage strips 46, 47 is again formed by the surface-treated inner peripheral surface 59 of a pressure pipe 58 lining the entire reception 7 of the coil spool 2. Identical to the second embodiment, the one pole shoes 5 of the electromagnet 1 comprises a pole plate 55 and a hollow cylindrical pole core 56 which extends axially away from this pole plate 55 into the reception 7 of the coil spool 2, while the other pole shoe 6 is configured as an annular pole plate 57 through which the pressure pipe 58 extends.

In this third embodiment, the armature 8 of the electromagnet 1 comprises on its end 60 connected to the push rod 10, only a relatively short reduced-diameter portion 61 which, in the live-state end position of the armature 8 shown in FIG. 9, sinks into a counterbore 62, best seen in FIG. 8, which again is arranged on the armature-proximate end of a through-bore 63 provided in the pole shoe 5 for the insertion of the push rod 10. An anti-stick disc 64 applied to the reduced-diameter portion 61 of the armature 8 prevents a direct seating of the armature 8 in the counterbore 62 of the through-bore 63 for the push rod 10.

Finally, it can be seen further in FIG. 10 that the ball cage strips 46, 47 are connected to each other by a retaining clip 65 to form an inexpensive strip assembly. In the dead-state end position of the armature 8 shown in FIG. 8, this retaining clip 65 is sunk into a cross groove 66 in the other end face 67 of the armature 8 in order not to shorten the stroke length of the armature 8.

What is claimed is:

1. An electromagnet for operating a hydraulic valve which hydraulic valve is installed within a hydraulic system of a device for varying valve timing in an internal combustion engine, said electromagnet comprising: at least one coil winding carried by a hollow cylindrical coil spool, which coil spool is circumferentially surrounded by a hollow cylindrical magnet housing and a pole shoe is mounted adjacent each end of the coil spool, said electromagnet further comprising an axially moveable cylindrical armature which is disposed in a hollow cylinder of the coil spool which hollow cylinder defines a reception for an armature, said armature being mounted in low friction rotary, longitudinally moveable axial guides, and electromagnetically produced axial movements of the armature are transmitted to a hydraulic valve piston against a force of a spring via a push rod which is connected to the armature to form an axial extension thereof, wherein the rotary, longitudinally moveable axial guides of the armature comprise at least one bushing-less linear ball cage having a number of circumferentially spaced balls, said cage also serving as an anti-stick means of the armature, an outer peripheral surface of the armature and/or an outer peripheral surface of the push rod defines an inner running track for the balls, and an inner peripheral surface of the pole shoes or an inner peripheral surface of a pressure pipe lining the reception of the armature define an outer running track for the balls.

2. An electromagnet of claim 1 wherein the rotary, longitudinally moveable guides of the armature are formed by two spaced-apart linear ball cages which are made of a plastic or of a non-ferromagnetic material, each cage comprising at least two circulating rows of balls having a number of circumferentially uniformly spaced balls.

3. An electromagnet of claim 2 wherein the linear ball cages are arranged opposite at end faces of the armature directly on the push rod which has an elongated configuration and extends axially through the armature, the outer peripheral surface of the push rod forming the inner running track for the balls of the linear ball cages.

4. An electromagnet of claim 2 wherein each pole shoe of the electromagnet comprises a pole plate and a hollow cylindrical pole core which extends axially away from the pole plate into the reception of the coil spool, and each pole core comprises a larger hollow cylinder section and a smaller hollow cylinder section, and inner peripheral surfaces of the smaller hollow cylinder section forming outer running tracks for the balls of the linear ball cage.

5. An electromagnet of claim 4 wherein the larger hollow cylinder section of the pole cores of both pole shoes which receive at least end regions of the armature are configured with a stepped transition to the smaller cylinder section of the pole cores of both pole shoes, and each stepped transition is configured as a stroke limiter for the armature.

6. An electromagnet of claim 5 wherein an annular collar is formed integrally on an end of each linear ball cage adjacent to the armature and, in stroke end positions of the armature, each annular collar is situated between an end face of the armature and the transition to the smaller hollow cylinder section of the respective pole core, and said annular collars are configured as anti-stick means of the armature to prevent a seating of the armature on transitions in the pole shoes.

7. An electromagnet of claim 5 wherein the pole shoes are made as soft iron extrusion molded parts whose ferromagnetic properties can be re-established by recrystallization annealing, at least the inner peripheral surfaces of the smaller hollow cylinders of the pole cores have an increased strength suitable for ball running tracks obtained by an additional surface treatment.

8. An electromagnet of claim 1 wherein the rotary, longitudinally moveable axial guides of the armature are configured as a single linear ball cage of a plastic or a non-ferromagnetic material which comprises at least two axially spaced-apart rows of balls, said linear ball cage being arranged on a reduced-diameter portion of the outer peripheral surface of the armature as the inner running track for the balls of the linear ball cage.

9. An electromagnet of claim 8 wherein one pole shoe of the electromagnet comprises a pole plate and a hollow cylindrical pole core extending axially away from the pole plate into the reception of the coil spool, while the other pole shoe comprises only an annular plate, and the reception is lined by a non-ferromagnetic pressure pipe whose inner peripheral surface is configured as the outer running track for the balls of the linear ball cage.

10. An electromagnet of claim 9 wherein the reduced-diameter portion of the armature forms a circumferential shoulder and has a larger axial dimension than the linear ball cage and, in one end position of the armature, this reduced-diameter portion passes with one end connected to the push rod into a counterbore of an axial through-bore of the one pole shoe of the electromagnet provided for insertion of the push rod.

11. An electromagnet of claim 10 wherein the linear ball cage is supported in the one end position of the armature on one side on the shoulder of the armature and on the other side of an end face adjacent to the armature of the pole core of one pole shoe, and said linear ball cage is an anti-stick spacer of the armature which prevents a seating of the armature in the counterbore of the through-bore of the one pole shoe for insertion of the push rod.

12. An electromagnet of claim 1 wherein the rotary, longitudinally moveable axial guides of the armature are configured as a single linear ball cage made of a plastic or a non-ferromagnetic material which comprises at least one row of balls and, axially spaced therefrom, a sliding bearing portion, said linear ball cage being arranged on a reduced-diameter portion of the outer peripheral surface of the armature which is configured both as the inner running track for the balls and as an inner sliding surface of the sliding bearing portion of the linear bearing cage.

13. An electromagnet of claim 12 wherein one pole shoe of the electromagnet comprises a pole plate and a hollow cylindrical pole core extending axially away from the pole plate into the reception of the coil spool, while the other pole shoe comprises only an annular plate, and the reception is lined by a non-ferromagnetic pressure pipe whose inner peripheral surface is configured as the outer running track for the balls and as an outer sliding surface of the sliding bearing portion of the linear bearing cage.

14. An electromagnet of claim 13 wherein the reduced diameter portion of the armature forms a circumferential shoulder and has a larger axial dimension than the linear ball cage and, in one end position of the armature, this reduced-diameter portion passes with one end which is connected to the push rod into a counterbore of an axial through-bore of the one pole shoe of the electromagnet provided for insertion of the push rod.

15. An electromagnet of claim 14 wherein the linear ball cage is supported in the one end position of the armature on one side on a shoulder of the armature and one the other side of an end face adjacent to the armature of the pole core of the one pole shoe, and said linear bearing cage is an anti-stick spacer of the armature which prevents a seating of the armature in the counterbore of the through-bore of the one pole shoe provided for insertion of the push rod.

* * * * *